US007601474B2

(12) United States Patent
Ogata et al.

(10) Patent No.: US 7,601,474 B2
(45) Date of Patent: Oct. 13, 2009

(54) ELECTROSTATIC TONER COMPOSITION TO ENHANCE COPY QUALITY BY IMPROVED FUSING AND METHOD OF MANUFACTURING SAME

(75) Inventors: Kenzo Ogata, Virginia Beach, VA (US); Shinichi Saiki, Virginia Beach, VA (US)

(73) Assignee: Mitsubishi Kagaku Imaging Corporation, Chesapeake, VA (US)

( * ) Notice: Subject to any disclaimer, the term of this patent is extended or adjusted under 35 U.S.C. 154(b) by 150 days.

(21) Appl. No.: 10/526,230

(22) PCT Filed: Sep. 9, 2003

(86) PCT No.: PCT/US03/25852

§ 371 (c)(1),
(2), (4) Date: Mar. 1, 2005

(87) PCT Pub. No.: WO2004/023215

PCT Pub. Date: Mar. 18, 2004

(65) Prior Publication Data

US 2005/0244735 A1 Nov. 3, 2005

Related U.S. Application Data

(60) Provisional application No. 60/408,878, filed on Sep. 9, 2002.

(51) Int. Cl.
*G03G 9/00* (2006.01)

(52) U.S. Cl. ..... 430/108.8; 430/123.5; 430/123.53; 430/124.1

(58) Field of Classification Search ..... 430/108.8, 430/123.5, 123.53, 124.1; 399/159
See application file for complete search history.

(56) References Cited

U.S. PATENT DOCUMENTS

| | | | | |
|---|---|---|---|---|
| 5,364,722 | A | 11/1994 | Tanikawa et al. | |
| 6,733,941 | B1 * | 5/2004 | Terauchi et al. | 430/108.8 |
| 2001/0033983 | A1 | 10/2001 | Ohno et al. | |

FOREIGN PATENT DOCUMENTS

| | | |
|---|---|---|
| JP | 6-75422 | 3/1994 |
| JP | 8-114942 | 5/1996 |
| JP | 8-278662 | 10/1996 |
| JP | 9-106105 | 4/1997 |
| JP | 9-160291 | 6/1997 |
| JP | 9-319133 | 12/1997 |
| JP | 10-123903 | 5/1998 |
| JP | 10-319628 | 12/1998 |

* cited by examiner

*Primary Examiner*—Mark A Chapman
(74) *Attorney, Agent, or Firm*—Oblon, Spivak, McClelland, Maier & Neustadt, L.L.P.

(57) ABSTRACT

An electrostatic developer is provided that contains toner-containing image-forming particles and an uncrosslinked, linear hydrocarbon based homopolymer wax component, wherein the wax has a total number of branches in each of one or more chains that is less than 0.5%, relative to total number of carbons in said wax; wherein the wax is further characterized by having a set of endotherms as determined by differential scanning calorimetry (DSC) run at a maximum rate of 10° C. per minute, these endotherms being characterized by a primary endotherm and at least a secondary endotherm, the primary endotherm exhibiting a temperature range of between 70° C. and 90° C., and the secondary endotherm exhibiting a temperature range of between 95° C. and 110° C., and wherein the wax has a crystallinity of from 75% to 90% as determined by small angle X-ray diffraction analysis.

15 Claims, 2 Drawing Sheets

Wax-A on Cooling

Wax-A on Heating

ELECTROSTATIC TONER COMPOSITION TO ENHANCE COPY QUALITY BY IMPROVED FUSING AND METHOD OF MANUFACTURING SAME

BACKGROUND OF THE INVENTION

1. Field of the Invention

The present invention relates to a developer for developing electrostatic latent images in electrophotography, electrostatic recording and electrostatic printing. More specifically, the present invention is directed to a composition and method that provides a developer which comprises toner particles and a wax to ensure the reduction and potential elimination of image offsetting by providing proper fixing or fusing during the electrophotographic process and maintaining a stable, high quality image, during extended use.

2. Description of the Background

Visible image forming methods associated with toners using electrophotographic systems have been extensively studied and are currently widely used. Typical examples of these techniques are dual-component developing methods, which use image-forming particles and often larger carrier particles, and mono-component developing methods, which use a toner comprising only magnetic or non-magnetic image-forming particles. Details of such developing methods are described in Kirk-Othmer, *Encyclopedia of Chemical Technology,* $4^{th}$ ed., 9:261-275 (1994).

An image forming apparatus utilizing an electrophotographic method with toner is well known. In the image forming apparatus utilizing the electrophotographic method, images are generally formed onto a sheet of copy paper through the following processes.

After uniformly charging a photoconductor that serves as an image-holding body, images are exposed onto the surface of the charged photoconductor. Attenuating electrostatic charges during the exposure of light forms a latent image. Then the electrostatic latent images are visualized by developing with toner to form a toner image. The toner images are transferred onto the aforementioned medium and thereafter fixed on it by heating, pressure or solvent vapor.

In recent years, accompanying the rapid growth of computer technology, digital copiers and printers have been developed and become widely used. In these machines, mono-component developing methods have been applied more often to reduce the number of supply parts and ease of customer maintenance requirements compared with that of the dual component method.

In the mono-component systems, toner is generally required to have good fluidity and uniform chargeability in order to form a good quality visible image as described in U.S. Pat. No. 5,802,284 incorporated herein by reference. The use of silica powder additives for toner particles to impart fluidity and chargeability properties has been widely studied and is one conventionally accepted method. Many US and international patents exist and are known that include the use of silica or silicon dioxide with toner of various compositions. A subset of these patents relates to surface treatments of silica or silicon dioxide for specific purposes to somehow enhance image quality characteristics relating to electrophotography. Examples of the use of hydrophobic silica particles for toner includes JP 46-5782 A, JP 48-47345A, and JP 48-47346A.

U.S. Pat. Nos. 5,464,722, 5,447,815, 4,868,084 5,702,858, 5,561,019, 4,902,570, 4,618,556, 5,695,902, and 6,004,711 all disclose the manufacture of toners using a form of silicone oils, varnishes, silicon dioxide particles or hydrophobic silica fine powder as some with surface treatments used as additives to enhance toner images.

The most common toner image fixing system for office and personal use printers and copiers uses a heat fixing method in which a heated device contacts a toner image on the substrate under an applied pressure. Offsetting in such a system often describes the soiling or improper marking on the imaged substrate by the toner. Cold offsetting is the term usually used to describe the soiling that occurs when the temperature of the fixing device is lower than the suitable toner fixing temperature range. In this case, insufficiently melted toner adheres to the surface of the fixing device and is subsequently deposited incorrectly onto the substrate. In contrast, when the fixing device temperature is higher than the suitable fixing range, the overly melted toner can adhere incompletely to the substrate due to a loss of elasticity resulting in adherence of toner to the fixing device. The subsequent soiling of the substrate is usually termed hot offsetting. Actual offsetting is a complex phenomenon and frequently related to many factors including surface properties of the substrate and the fixing device material, chemical and physical properties of the toner, and toner particle size.

One method which has been found to reduce or eliminate offsetting includes the use of wax additives that have low softening temperatures so the resultant electrostatically transferred toner images are fixed without smearing, improper spacing between lines and/or characters or margin offset.

In a recent JP filing, JP 10-73952, a color toner formulation with a wax with a number average molecular weight (Mn) between 1500 and 7000 is claimed to provide better results regarding fusing characteristics. Normally, lower number average molecular weight (Mn) waxes have been associated with a phenomenon known as "bleeding". In addition, this Kokai patent claims that the ratio of branched carbons to the total carbons in the wax is between 0.5 and 20.

Sakashita, U.S. Pat. No. 5,051,331, discloses a toner comprising a binding resin and a low molecular weight olefin copolymer. Sakashita teaches the low-molecular weight olefin copolymer has at least two olefin monomer repeating units and has two or more peaks of melting at temperatures between 90 C and 170 C.

Tanikawa et al. U.S. Pat. No. 5,364,722, disclose a toner comprising a binder resin and a hydrocarbon wax, and heat-fixing methods using the toner. Tanikawa et al. teach that the binder resin may be composed of homopolymers of styrene and derivatives thereof, and styrene copolymers, such as styrene-acrylate copolymer. Tanikawa et al. further teach the hydrocarbon wax provides a differential scanning calorimeter curve showing an onset temperature of heat of absorption in the range of 50 to 100 C, and at least one heat absorption peak in the range of 70-130 C.

Hagiwara et al., U.S. Pat. No. 5,389,484, disclose a toner having a binding resin having an acid component with an acid value of from 0.5 mg KOH/g to 100 mg KOH/g, a colorant, and defined aromatic amines. Hagiwara et al. teach that the acid component of the resin interacts with the amino group of the aromatic compounds to form an amide bond thereby cross-linking the polymer chains. Hagiwara et al. further teach that this can impart a rubber elasticity to the toner, so that its anti-offset properties can be improved.

Suzuki et al., U.S. Pat. No. 5,538,828, disclose a toner resin composition comprising a binder primarily composed of vinyl copolymer and an ethylene copolymer. Suzuki et al. further teach the ethylene copolymer is prepared by copolymerizing ethylene and at least one alpha- or beta-derivative of acrylic acid or an unsaturated dicarbonic acid derivative.

Suzuki et. al. further teach toner-separating agents such as a low molecular weight polyester or polypropylene wax may be added.

Taguchi et al., U.S. Pat. No. 5,466,555, disclose a releasing composition for a toner comprising a low molecular weight polypropylene and at least one modified polyolefin. Taguchi et al. teach that suitable polypropylenes include polypropylene homopolymers, and copolymers of polypropylene with one or more other monomers copolymerizable therewith, for example, ethylenes and olefins. The releasing composition may be used in toner which comprises the releasing agent, colorant, and binder resin. Taguchi et al. teach suitable binder resins include styrenic and/or acrylic resins.

Sawai et al., U.S. Pat. No. 5,565,294, disclose a toner containing a colorant, a binding resin, and a polyethylene having a melt viscosity of 22000 to 26800 mPa-s at 140 C. Sawai et al. teach that when the melt viscosity of the polyethylene is less than 2200 mPa-s at 140 C, toner components are not evenly dispersed in the kneading step in the production process of toner.

Inoue et al., U.S. Pat. No. 5,658,999, disclose production of propylene waxes by polymerizing propylene with a solid catalyst formed of a transition metal compound or a reaction product between the transition metal compound and an organometallic compound, an aluminoxane and a fine particulate carrier. Inoue et al. further discloses a toner composition composed essentially of a binder resin, a colorant, and as a releasing agent, a propylene wax.

Akimoto et al. U.S. Pat. No. 5,707,772, disclose a toner comprised of a resin, a colorant, and a releasing agent. Akimoto et. al. teach the releasing agent is a low molecular weight polyolefin polymer synthesized using a metallocene catalyst. Akimoto et al. further teach the number average molecular weight of the polyolefin is from 2000 to 10000, and the ratio of weight average molecular weight to number average molecular weight (Mw/Mn) is 1.6 to 3.5.

Osterhoudt et al., U.S. Pat. No. 5,811,214, disclose a developer comprising negatively charged toner particles comprising a polymeric binder, magnetic material, and a charge control agent wherein the toner particle surface contains particles of cerium dioxide, dimethyldichlorosilane treated silica, and dimethylsiloxane treated silica. Osterhoudt et al. teach the polymeric binder may comprise styrene and an acrylate and/or methacrylate. Osterhoudt et al. further teach that useful additives include release agents such as waxes, including copolymers of ethylene and propylene having a molecular weight of 1000 to 5000 g/mole.

Eguchi et al. U.S. Pat. No. 5,928,825, disclose a toner comprising a binder resin, a colorant, and a lubricant. Eguchi et al. teach the lubricant comprises a modified polyethylene wax obtained by grafting a monomer selected from the group consisting of styrene and unsaturated carboxylic acid onto an ethylene homo- or copolymer.

Hashimoto et al., U.S. Pat. No. 5,948,584, disclose a toner comprising toner particles containing at least a binder resin, a colorant and a wax. Hashimoto et al. teach that the binder resin comprises a hybrid component comprising a vinyl polymer component and a unit of polyester component bonded to each other.

Kuwashima et al., U.S. Pat. No. 5,952,138, disclose a magnetic developer comprising a magnetic toner containing at least a binder resin, a magnetic material, and a hydrocarbon wax which is synthesized by reaction of carbon monoxide with hydrogen or by polymerizing ethylene and which has a number average molecular weight of from 600 to 1000. Kuwashima et al., teach the wax should have an acid value of less than 2.0 mg KOH/g, and that if the acid value is higher than 2.0 mg KOH/g, the wax's interfacial adhesion to the binder resin may become so large that smearing of characters results.

Urashima, et al., U.S. Pat. No. 5,955,233, disclose a toner comprising a polymer obtained by suspension polymerization in an aqueous medium of a polymerizable monomer composition, a coloring agent, and optionally, a magnetic powder in the presence of an epoxy resin and a crystalline (meth) acrylic ester type polymer. Urashima et al. further teach an offset-preventing agent may be incorporated, and that suitable offset-preventing agent may include polyolefin wax which has a weight average molecular weight in the approximate range of 1000 to 4500, preferably 2000 to 6000, such as homopolymers of polyethylene, polypropylene and polybutylene, or olefin copolymers such as ethylene-propylene copolymer.

Livengood, et. al. U.S. Pat. No. 6,331,372, disclose a toner particulates including a wax comprising an ethylene polypropylene copolymer with a non-crosslinked copolymer other than the wax also comprising an ethylene propylene copolymer. The U.S. Pat. No. 5,707,771 and related U.S. Pat. No. 5,955,234 disclose a toner for developing an electrostatic image comprised of a binder resin, a colorant and a wax where the toner has specific rheological characteristics based on elastic storage modulus at specific frequencies where the toner shows a good fixability even at a high colorant content and shows an improved fixability during fusing that occurs immediately after power is supplied to a fixing device in a cold environment. The binder resin may preferably include a low-modulus component and a high-modulus component. The waxes may preferably include both a high-melting point wax component and a low melting point wax component.

U.S. Pat. No. 5,635,325 discloses a toner for developing electrostatic images that includes at least a binder resin, a colorant and an ester wax. The ester wax is contained in 3-40 wt. parts per 100 wt. parts of the binder resin. The ester wax includes ester compounds represented by a formula of;

$$R_1—COO—R_2$$

wherein $R_1$ and $R_2$ independently denote a hydrocarbon group of 15-45 carbon atoms. The ester wax contains 50-95 wt. % thereof of ester compounds having an identical number of total carbon atoms. The toner is especially characterized by low-temperature fixability, wide non-offset temperature range, good color mixing characteristics and transparency.

U.S. Pat. No. 5,741,617 describes a toner for developing electrostatic images, which comprises a binder resin, a colorant and a wax composition, characterized in that the wax composition has a molecular weight distribution as measured by GPC containing an ester wax with a weight average molecular weight (Mw) of from 350 to 4000 and a number average molecular weight of from 200 to 4000.

U.S. Pat. No. 5,747,213 details a method of forming a color toner image where the color toner contains at least a binder resin, a colorant and wax, the wax having a molecular weight distribution measured by GPC.

Finally, U.S. Pat. No. 5,840,457 summarizes many of the solid toner wax properties found to be useful for toner resin with magnetic black toner particles that are used to help control the degree of gloss, leave little residual toner, provide a high transfer efficiency, cause little abrasion of the OPC and other cartridge components, and results in less image defects due to soiling of the members pressed against the bearing member. Several wax characteristics are summarized in U.S. Pat. No. 5,840,457 and it is indicated in this patent that low-molecular weight hydrocarbon waxes, as well as polyethylene waxes and long-chain alkyl alcohol waxes are best suited to providing efficient transfer and good gloss and with the waxes that possess physical characteristics comprising a Mw/Mn=1.0-2.0 and a DSC heat absorption main peak between 60 and 120 C.

Many references exist regarding toner compositions including wax combinations to enhance fusing performance. The use of the proper combination for each specific composition is, however, unique and complex and therefore the need for proper wax agents in current specific formulations still exists.

SUMMARY OF THE INVENTION

It is an object of the present invention to provide an electrostatic developer composition and method of using such a composition wherein toner performance is controlled such that the toner is suitable for the specific development system, and is capable of stable high image quality as determined by image density, background, resolution and other general requirements during long term use.

Another object of the present invention is to provide a toner that reduces or eliminates the phenomena known as offsetting, smearing, or other print imperfections. Use of a specific wax has been shown to reduce the build-up of toner onto the fixing devices. There are essentially three basic features of the present invention that are unique: first, development of a toner composition with better fusing properties as measured by tape peeling and rubbing that characterizes the prevention of smudging or fusing as a result of the fusing roller and/or fusing belt apparatus remaining free from contamination or toner buildup; second, the prevention of this toner buildup also helps reduce build-up around the picker-finger; third, the wax of the present invention also reduces friction between the paper and the picker-finger allowing for easier release of the picker-finger from the paper reducing the propensity for scratches. In all three cases the use of the wax in the toner composition of the present invention leads to better image quality including higher image density (ID), lower background (BG), etc.

In addition, the toner allows for a wider temperature operating range of the fixing device without offsetting.

Another object of the present invention is to provide a toner which is capable of stable long-term performance without any undesired toner contamination of the electrophotographic system including the photoconductor, the direct photoconductor charging apparatus, the fusing roller or fixing system.

These and other objects of the present invention have been satisfied by the discovery of an electrostatic developer comprising toner-containing image-forming particles and an uncrosslinked, linear hydrocarbon based homopolymer wax, wherein said wax has a total number of branches in each of one or more chains that is less than 0.5%, relative to a total number of carbons in said wax, wherein said wax is further characterized by having a set of endotherms as determined by differential scanning calorimetry (DSC) run at a maximum rate of 10° C. per minute, said endotherms characterized by a primary endotherm and at least a secondary endotherm, said primary endotherm exhibiting a temperature range of between 70° C. and 90° C. and said secondary endotherm exhibiting a temperature range of between 95° C. and 110° C.;

and wherein said wax has a crystallinity of from 75% to 90% as determined by small angle X-ray diffraction analysis.

DETAILED DESCRIPTION OF THE INVENTION

Figure 1A:
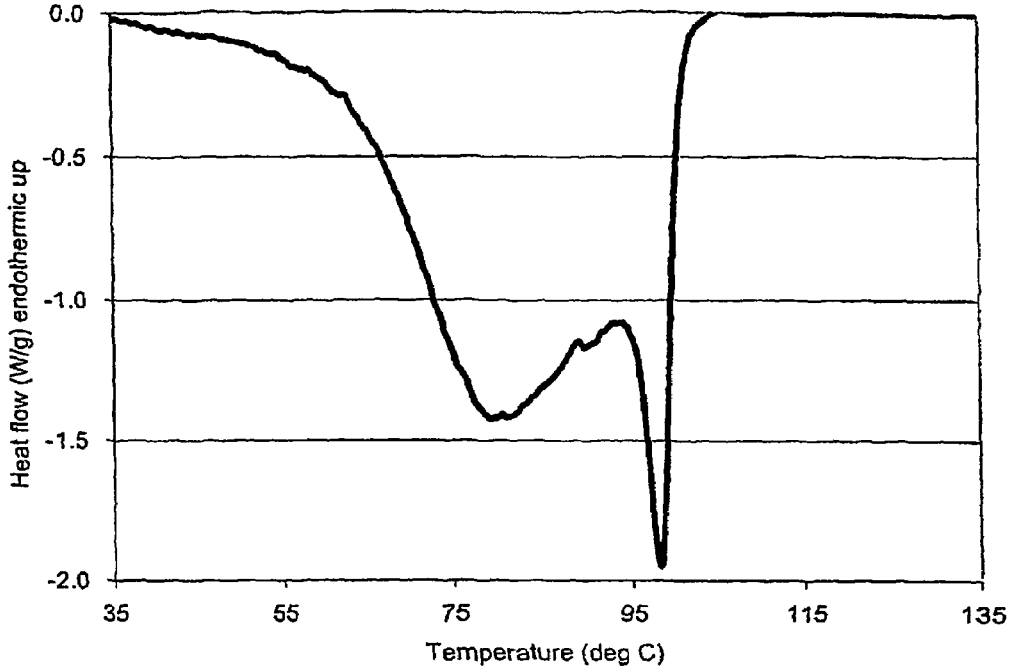
FIG. 1 provides a sample DSC (differential scanning calorimetry) scan of a most preferred wax used in the toner of the present invention.

The toner components of the present invention comprises a mixture of (1) toner components containing image-forming particles, (2) a low softening temperature, nearly linear hydrocarbon based homopolymer wax with a specific molecular weight and crystallinity.

The above combination of components allows for high image density and clear images without offsetting formed during the electrophotography process. The development of this process is at high-resolution power and indicates improved electrostatic recording is obtainable.

In electrophotography, electrostatic recording, or the like, in which the developing method and the toner according to the present invention are used, the image-forming particles do not transfer to the non-image area and proper, non-offset images can be formed, thereby providing great industrial merit.

In the present invention, it is shown that a specific number average molecular weight wax with little or no branching, provides for better fusing. In addition, and in contrast to conventional systems, it is shown that image density (ID) can be maintained using this specific wax, whereas conventional waxes with specific molecular weights sometimes result in toner compositions that also result in lower ID's. Finally, it has also been shown by further analysis, that the wax of the present invention would include less than 0.5% branching based on the total number of carbon atoms in the wax molecule.

Here the branching or branch carbons preferably include those carbons contained in the main chain.

It is desirable that the toner not accumulate excessively on the fuser roller, for excessive accumulation can result in mechanical failure of the fuser. The inventors have found that toner particles comprising a low softening temperature non-crosslinked linear hydrocarbon based homopolymer wax with a specific molecular weight and crystallinity provides very good print quality without accumulating on the fuser roller to a degree which is likely to cause mechanical failure. Moreover, this special wax additive reduces or eliminates the phenomenon known as offsetting and provides for proper fusing of the toner particles.

Toner particles in accordance with the present invention comprise a resin, a wax comprising a low softening temperature non-crosslinked linear hydrocarbon based homopolymer with a specific molecular weight and crystallinity, and optionally ingredients such as magnetic components, colorants and charge control agent.

Another embodiment of the invention includes an electrostatic developer which comprises a toner containing image-forming particles and an uncrosslinked, linear hydrocarbon based homopolymer wax component, wherein said wax has the total number of branching carbon atoms present in each of one or more chain branches that is less than 0.5%, relative to the total number of carbons in said wax, and;

said wax is further characterized by having a set of endotherms as determined by differential scanning calorimetry (DSC) run at a rate of 10° C. per minute, said endotherms characterized by a primary endotherm and at least a secondary endotherm, said primary endotherm exhibiting a temperature range of between 70° C. and 90° C., and said secondary endotherm exhibiting a temperature range of between 95° C. and 110° C., and;

wherein said wax has a crystallinity of from 75% to 90% as determined by X-ray diffraction analysis.

and;

wherein said wax is also characterized by having a molecular weight polydispersity (Mw/Mn) in the range of 1.1-1.3, where the number average molecular weight is in the range of 700-790 and the weight average molecular weight is in the range of 890-1000.

Toner Components

The toner in the present invention can be prepared by any of the generally known methods in the art and various known toner constituent ingredients can be used.

Binder resins for the toner can be selected from a wide variety of materials including known thermoplastic resins. There can be mentioned, for example, styrene resin (homo- or copolymer containing styrene or substituted styrene) such as a polystyrene, polychlorostyrene, poly-methylstyrene, styrene-chlorostyrene polymer, styrene-propylene copolymer, styrene-butadiene copolymer, styrene-vinyl chloride copolymer, styrene-vinyl acetate copolymer, styrene-maleic acid copolymer, styrene-acrylate copolymer (for example, styrene-methyl acrylate copolymer, styrene-ethyl acrylate copolymer, styrene-butyl acrylate copolymer, styrene-octyl acrylate copolymer and styrene-phenyl acrylate copolymer), styrene-methacrylate copolymer (for example, styrene-methyl methacrylate copolymer, styrene-ethyl methacrylate copolymer, styrene-butyl methacrylate copolymer and styrene-phenyl methacrylate copolymer), styrene-methyl α-chloroacrylate copolymer and styrene-acrylonitrile-acrylate copolymer, vinyl chloride resin, resin modified maleic acid resin, phenolic resin, epoxy resin, saturated or unsaturated polyester resin, low molecular weight polyethylene, low molecular weight polypropylene, ionomer resin, polyurethane resin, silicone resin, ketone resin, ethylene-ethyl acrylate copolymer, xylene resin and polyvinyl butyral resin. Preferred resins include styrene resins, and saturated or unsaturated polyester resins. Further, the above-mentioned resins may be used not only alone, but also as a combination of two or more of them.

Resins typically exhibit a softening temperature and a flow temperature. As used herein "softening temperature" is intended to refer to the temperature at which particle collapse begins, and "flow temperature" is intended to refer to the temperature at which the resin achieves sufficient liquidity to be extruded in a capillary rheometer. The softening temperature can be determined using rheometers such as the SHIMADZU® capillary rheometer.

The resins for use in toner particulate may include a crosslinking agent in an amount of from about 0.01 to about 5 parts by weight per 100 parts by weight of the monomers employed therein. Conventional crosslinking agents may be used. In one embodiment, the toner comprises a resin which is free of crosslinking agents.

Toner particles may comprise more than one resin. Generally, the resins will have a glass transition temperature of no less than 50° C. In one embodiment the particulate comprises a first resin and a second resin, each resin having a glass transition temperature of no less than about 50° C., preferably no less than about 55° C. Generally the resins will have molecular weight greater than about 2000.

In order to use the toner of the present invention in the form of a magnetic toner, magnetic powder generally known in the art may also be incorporated therein. The magnetic powder for the toner of the present invention is preferably chosen from the ferromagnetic materials exhibiting ferromagnetism including ferrimagnetism in a working circumstance temperature (around 0 to 60° C.) for office business machines, plain paper copiers, printers, etc. For example, there can be mentioned magnetic powder showing ferromagnetism or ferrimagnetism in a temperature range of about 0 to 60° C., selected from magnetite ($Fe_3O_4$), maghemite (—$Fe_2O_3$), a complex of magnetite and maghemite, spinal ferrite such as ferrite ($M_xFe_{3-x}O_4$ in which M represents Mn, Fe, Co, Ni, Cu, Mg, Zn, Cd or mixed crystal materials thereof), hexagonal ferrites such as $BaO.6Fe_2O_3$, garnet-type oxide such as $Y_3Fe_5O_{12}$, retile-type oxide such as $CrO_2$, metal such as Fe, Mn, Ni, Co, and Cr, as well as other ferromagnetic alloys. Among them, a powder of magnetite, maghemite or a complex product of magnetite and maghemite with an average particle size of not more than 3 μm, about 0.01 to 1 μm are preferred in view of the performance and the cost. The above-mentioned magnetic powder may be used not only alone but also as a combination of two or more of them.

As an example of manufacture of mono-component magnetic toner, the blending weight ratio of the binder resin to the magnetic powder can be selected within a range from 1:3 to 7:1, while taking the fixing property to a transfer material into consideration.

As a colorant used for the toner, any of known dyes and pigments such as carbon black, lamp black, ultramarine, nigrosine dye, aniline blue, phthalocyanine blue, phthalocyanine green, hanza yellow G, rhodamine type dye and pigment, chrome yellow, quinacridone, benzidine yellow, rose bengale, triallylmethane dyes, monoazo and disazo dyes and pigments may be used alone or in admixture. The addition amount of the colorant into the toner is preferably from 0.1 to 30 parts by weight, more preferably 0.5 to 10 parts by weight, based on 100 parts by weight of the binder resin. The fixing properties become poor if the amount is excessive, thus showing tendencies in property performance that is undesirable.

The charging property of the toner in the present invention may be controlled by the binder resin or the dye and pigment per se and, if required, a charge control agent causing no problem in view of color reproduction may also be used together. It is also possible to include charge control resins.

Examples of the charge controller are well known by way of reference for example, U.S. Pat. No. 4,957,840, incorporated herein by reference. For positive charge control agents, examples may include: nigrosine and its modification products modified by a fatty acid metal salt; quaternary ammonium salts, such as tributylbenzyl-ammonium-1 hydroxy-4-naphthosulfonic acid salt, and tetrabutylammonium tetrafluoroborate; diorganotin oxides, such as dibutyltin oxide, dioctyltin oxide, and dicyclohexyltin oxide; and diorganotin borates, such as dibutyltin borate, dioctyltin borate, and dicyclo-hexyltin borate; and triphenylmethane compound. These positive charge controllers may be used singularly or as a mixture of two or more species. As another type of positive charge controller, there may be use of a homopolymer of a monomer having an amino group represented by the formula:

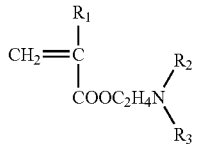

wherein $R_1$ represents H or $CH_3$;

and $R_2$ and $R_3$ each represent a substituted or unsubstituted alkyl group (preferably $C_1$-$C_4$); or a copolymer of the monomer having an amine group with another polymerizable monomer such as styrene, acrylates, and methacrylates as described above. In this case, the positive charge controller may also function as a binder.

Examples of negative charge control agents include: metal complexes or salts of monoazo dyes, salicylic acid, alkylsalicylic acid, dialkylsalicylic acid, naphthonic acid, or acetylacetone. It is preferred that the above-mentioned charge controller is used in the form of fine powder. In such a case, the number-average particle size thereof may preferably be 4 microns or smaller, more preferably 3 microns or smaller.

In the case of internal addition, such charge controller may preferably be used in an amount of 0.1-20 wt. parts, more preferably 0.2-10 wt. parts, per 100 wt. parts of a binder resin by taking into consideration the conditions for the manufacturing method including the chargeability of the binder resin, the addition amount of the colorant and the dispersion method, as well as the chargeability of the other additives.

The toner in the present invention may preferably have a volume median particle size from 4 to 20 μm, more preferably from 5 to 15 μm, and most preferably from 6 to 12 μm, where the volume median particle size is obtained by using a Coulter counter Model Multisizer with a 100 micron aperture.

The toner of the present invention may contain one or more of the following external ingredients in small amounts, preferably 5% or less, more preferably 2% or less, still more preferably 1% or less, based on total amount of toner: straight chain saturated fatty acids such as palmitic acid, stearic acid and montanic acid; unsaturated fatty acids such as brassidic acid, eleostearic acid and parinnaric acid; saturated alcohols such as stearyl alcohol aralkyl alcohol, behenyl alcohol, carnaubyl alcohol, ceryl alcohol and melissyl alcohol; polyhydric alcohols such as sorbitol; fatty acid amides such as linolic acid amide, oleic acid amide, and lauric acid amide; saturated fatty acid bisamides such as methylenebisstearic acid amide, ethylenebiscapric acid amide, ethylenebislauric acid amide, and hexamethylenebisstearic acid amide; unsaturated fatty amides such as ethylenebisoleic acid amide, hexamethylenebisoleic acid amide, N,N'-bis-dioleyladipic acid amide and N,N'-bis-dioleylsebacic acid amide; aromatic bisamides such as xylene-bis-stearic acid amide and N,N'-distearylisophthalic acid amide; fatty acid metal: salts (what are commonly called metal soaps) such as calcium stearate, calcium laurate, zinc stearate, and magnesium stearate; waxes obtained by grafting vinyl monomers such as styrene and acrylic acid onto aliphatic hydrocarbon waxes; partially esterified products of fatty acids such as behenic acid monoglyceride with polyhydric alcohols; and methyl ester compounds having a hydroxyl group, obtained by hydrogenation of vegetable fats and oils.

Organic particles for charge control that are employed in the toner compositions may be chosen separately from resinous materials. Examples of such resinous materials are exemplified by, but not limited to, thermoplastic resins such as polystyrenes, poly(meth) acrylic resins, polyolefin resins, polyamide resins, polycarbonate resins, polyether resins, poly (sulfine acid) resins, polyester resins, epoxy resins, polybutyral resins, urea resins, urethane/urea resins, silicon resins, polyethytlene resins, Teflon resins and the like (fluoropolymer resins), thermosetting resins, a mixture thereof, block copolymers thereof, graft copolymers thereof, a blend thereof, and the like.

The inorganic oxide particles that are employed for toner compositions may also be prepared by any methods known in the art and are preferably selected from the group consisting of $SiO_2$, $Al_2O_3$, $W_2O_3$, $ZrO_2$, SeO, $TiO_2$, ZnO and MgO. The particles preferably have a BET measurement value of not less than 1 $m^2/g$, more preferably not less than 30 $m^2/g$ and even more preferably not less than 100 $m^2/g$.

The toner of the present invention can be used in conventional electrophotography processes using conventional toner cartridges. Such electrophotography processes and toner cartridges are well known in the art. Some have been described in various patents cited herein and incorporated by reference. Others are detailed in U.S. Pat. Nos. 6,391,510 and 5,520,229, the relevant portions of which are hereby incorporated by reference.

Toner Wax

The toner used in the present invention contains the linear wax which is an uncrosslinked, linear hydrocarbon based homopolymer, wherein the wax has a total number of branches present in each of one or more chains that is less than 0.5% relative to the total number of carbons in said wax. The wax is further characterized by having a set of endotherms as determined by differential scanning calorimetry (DSC) It consists of the primary endotherm and at least a secondary endotherm: the primary endotherm exhibits a temperature range of between 70° C. and 90° C. and the secondary endotherm exhibits a temperature range of between 95° C. and 110° C.

DSC test results were determined by running one heating followed by one cooling followed by one heating cycle each at 10° C. per minute, with an initial heating and cooling cycle prior to the second heating during which test measurements were made.

The wax further has a crystallinity of from 75% to 90% as determined by X-ray diffraction analysis.

X-ray diffraction analysis was performed in a URTRAX 18 (manufactured by Rigaku) X-ray device utilizing a 40 kV-200 mA (8 kW) source. A sample wax powder was prepared for a cell 1 mm in thickness. The sample was heated to 130 C and held at that temperature for 5 minutes. Next, the sample was cooled to 60 C at 0.91 C/min and then left to continue cooling at ambient temperature for 2 hours.

The detection comprised;

A Cu Ka line monochromated by a graphite monochromater

A collimator 1 mm in diameter

A Slit of 0.5 mm×0.5 mm (height×width)

A detector scintillation counter and;

A step scan: 2 theta=10-20 degrees, at 0.1 deg/step, 20 seconds/step.

Crystallinity was calculated utilizing Igor Pro Software from Wavemetrics Corporation to separate and identify the peaks to crystal faces.

The wax is also characterized by having a molecular weight polydispersity (Mw/Mn) in the range of 1.1-1.3, with a number-average molecular weight in the range of 700-790 and a weight average molecular weight in the range of 890-1000.

Molecular Weight test results were determined by GPC analysis using PL-210 instrument from Polymer Laboratories, using a 30 cm×4 column of TSGgel GMH-HT (Toso) and ODCB (o-dichlorobenzene) as eluent, and a refractive index (RI) detector. The flow rate was 1.0 mL/min. The sample was injected as a 0.1 wt % solution in the eluent and in an amount of 500 μL. The column temperature was maintained at 135° C. The results were determined against a polystyrene standard with a cubic fit calibration curve, along with a universal calibration curve with the viscosity equation of polystyrene standard and polyethylene of Kps=1.38E-4, α ps=0.70, Kpe=4.77E-4, α pe=0.70.

The wax of the present invention has branching that has been further characterized by NMR as;

0-0.20 methyl branches per 100 carbon atoms, 0-0.10 ethyl branches per 100 carbon atoms and 0-0.10 butyl branches per 100 carbon atoms.

$^{13}C$ NMR spectrum was quantitatively analyzed to determine the numbers of branching carbons in the molecule. The NMR instrumentation included a Varian UnityPlus 400 with sample preparation utilizing the proton complete decoupling method as follows;

Resonance frequency: 100.56 MHz

Temperature: 130 C

Pulse Angle: 45 degrees

Pulse Interval: 20 seconds

Solvent: o-DCB/p-DCB d4

(DCB=dichlorobenzene, "d4" means that all of the four hydrogens were substituted with Deuterium)

The wax of the present invention preferably has a mean particle size of from 1 to 10 μm, more preferably from 4-7 μm. The particle size for the wax has been determined by use of a Beckman Coulter Multisizer 3.33.

The wax of the present invention is also preferably prepared by a process comprising; gasifying and subsequent liquifying of coal resulting in residual wax residue forming in a reactor vessel, the reactor vessel containing sides with interior surfaces, wherein wax residue forms specifically on the surfaces of the sides of the vessel, the vessel used for coal gasification and liquification followed by milling of the wax, substantially by a jet mill to accomplish micronizing and classifying of the linear hydrocarbon wax.

The wax is to provide an electrostatic developer comprising a toner of thermal fixing type which is capable of providing a reprographic image which exhibits good release properties upon thermal fixing, a reduced adhesion to the heated roller or the heated film, no offset or contamination, and good fixing properties of the fixed image, and is capable of preventing the heated roll or the heated film from undergoing contamination.

Two test methods have been used to determine fusing strength for fusing properties where fusing strength is descriptive of the bond strength between the paper and the toner subsequent to the electrophotographic process. Once toner has been deposited on the paper and exposed to the fusing conditions, the toner has a fusing strength.

One test method, known as the "tape peeling test" includes the use of an adhesive tape, specifically Scotch 3M Magic Tape (¾ inch width). The image density (ID) is measured before and after the tape is applied and removed.

The second test method, known as the "Rub Test Reference" uses the back side (non-adhesive side) of a Self-Stick Removable Notes Pad manufactured by either 3M or Highland. Non-adhesive paper side is placed over the fused toner image and is rubbed or moved from the top to the bottom of the paper (usually 2⅞"×2⅞"). After the "rub" is complete, the paper is examined and a number is associated with the "smudge" if there is one. The numbering system is as follows;

1: No smudge—acceptable

2: Very slight and no smear—acceptable

3: Slight: some smudging—marginal

4: Smear after rubbing is very apparent—unacceptable

5: Bad and lots of smear after rubbing—very unacceptable

It is permissible that the specific wax of the invention is used with one or more of those wax components such as polypropylene (PP) or polyethylene (PE) as listed in U.S. Pat. No. 5,840,457 and/or with one or more auxiliary agents such as various kinds of plasticizers and releasing agents for adjusting thermal properties, physical properties, etc. The addition amount thereof is preferably from 0.1 to 20 parts by weight based on 100 parts by weight of the binder resin, and even more preferably from 1-6 parts, by weight based on 100 parts by weight of the binder resin.

Having generally described this invention, a further understanding can be obtained by reference to certain specific examples that are provided herein for purposes of illustration only and are not intended to be limiting unless otherwise specified. These examples describe, but are not limited to, the preparation of toner by conventional process means as below.

EXAMPLES

In the following Examples and Comparative Examples, "parts by weight" is merely written as "parts".

Example 1

One hundred parts of a styrene-butyl acrylate copolymer ($Mw=15.5\times10^{4)}$, 90 parts of magnetite, 4 parts of Wax-A, which was nearly linear hydrocarbon based homopolymer wax with a specific molecular weight (Mn=750 and Mw=966) and crystallinity (80.4%), and 1 part of a chromium based organic metal complex were all well blended and kneaded by means of a twin screw extruder. The kneaded product was cooled, coarsely crushed by hammer mill, finally pulverized and classified to obtain black particulate having a volume median particle size of 9.0 microns.

Then 100 parts of the above black particulate were mixed with 1 part of TG308F (Cabot) negatively charged silica, which was fumed and post-treated with polydimethylsiloxane (PDMS). The resultant mixture was passed through a 100-mesh sieve.

Comparative example C1 was the same as Example 1 except for using PE130 (Clariant) in place of Wax-A. Another comparative example C2 was the same as Example 1 except for using NP505 (Mitsui Chemical) in place of Wax-A.

Those toner samples were subjected to print tests using a 50 (prints/minute) speed laser printer machine. The approximate fuser temperature was 180 C. The fusing apparatus was visually inspected for contamination.

Example 1 toner (Ex-1) showed good fusing properties as measured by tape peeling and rubbing. The prints with Ex-1 had no fusing picker finger scratches. The fusing unit was free from contamination after running with the Ex-1 toner.

TABLE 1

Working and Comparative Examples of Electrostatic Developer with Varying Amounts of Low Softening Temperature, Nearly Linear Hydrocarbon Based Homopolymer Wax

| Sample | Wax (4 parts) | ID | Tape Test | Rub Test Reference | Picker Finger | Contamination |
|---|---|---|---|---|---|---|
| Ex-1 | Wax-A | 1.43 | ○ | ○ | ○ | No contamination |
| C.1 | PE130 | 1.33 | X | ○ | Δ | No contamination |
| C.2 | NP505 | 1.32 | X | X | X | Contamination |

*1: Evaluation was carried out under normal temperature and humidity (N,N = 20-25 degree C., 40-70% RH) conditions.
*2: ID was measured by a Macbeth RD914 Colorimeter
*3: Tape test was conducted using Highland tape and observed resultant image smudging
*4: Paper rubbing was conducted by using Post-It$^R$ and observed resultant image smudging
*5: Picker finger soil was observed on black page print.
*6: Contamination of fusing apparatus was observed after 30,000 pages.

The toner samples were tested using several different fusing conditions, changing fusing temperature and fusing speed to confirm the non-offsetting range. Unfused prints using the toner samples were taken from a modified laser printer (HP LaserJet4Plus). The fusing apparatus was a modified fusing unit of HP LaserJet5Si for this fusing test. This test indicated Ex-1 toner had a wider non-offsetting fusing range than C1 or C2.

a pulse angle: 45 degrees a pulse interval: 20 seconds and the solvent: o-DCB/p-DCB d4

(DCB=dichlorobenzene, "d4" means that all of the four hydrogens were substituted with Deuterium)

Wax-A had a crystallinity of 80.4-80.6% as determined by X-ray diffraction analysis.

Crystallinity test results were determined by X-ray diffraction analysis was performed in a URTRAX 18 (manufactured by Rigaku) X-ray device utilizing a 40 kV-200 mA (8 kW) source. A sample wax powder was prepared for a cell 1 mm in thickness. The sample was heated to 130 C and held at that temperature for 5 minutes. Next, the sample was cooled to 60 C at 0.91 C/min and then left to continue cooling at ambient temperature for 2 hours.

The detection comprised;

a Cu Ka line monochromated by a graphite monochromater a collimator 1 mm in diameter a Slit of 0.5 mm×0.5 mm (height×width)

a detector scintillation counter and;

a step scan: 2 theta=10-20 degrees, at 0.1 deg/step, 20 seconds/step.

TABLE 2

Offsetting Performance for Example Toners Under Various Fusing Conditions

| Fusing Speed | mm/s | 78 | 70 | 62 | 50 | 42 | 42 | 42 | 42 | 42 | 42 | 42 | 42 | 34 | 25 | 17 | 8 |
|---|---|---|---|---|---|---|---|---|---|---|---|---|---|---|---|---|---|
| Fuser Temp. | Deg. C. | 130 | 130 | 130 | 130 | 130 | 140 | 150 | 160 | 170 | 180 | 190 | 200 | 200 | 200 | 200 | 200 |
| Example No. | Ex. 1 | 4 | 3 | 2 | 2 | 1 | 1 | 1 | 1 | 1 | 1 | 1 | 1 | 1 | 1 | 1 | |
| Comparative Example No. | C-1 | 5 | 3 | 2 | 2 | 2 | 1 | 1 | 1 | 1 | 1 | 1 | 1 | 1 | 1 | 1 | 4 |
| Comparative Example No. | C-2 | 5 | 5 | 3 | 3 | 2 | 3 | 3 | 2 | 2 | 2 | 2 | 1 | 1 | 1 | 1 | 1 |

1: No offsetting - acceptable
2: Very slight offsetting - acceptable
3: Slight: some offsetting - marginal
4: Offsetting is very apparent - unacceptable
5: Severe offsetting - very unacceptable For characterization and evaluation of Wax-A;

DSC indicated that Wax-A had the primary endotherm at 82-83 C and the secondary endotherm at 104 C.

Figure 1B:
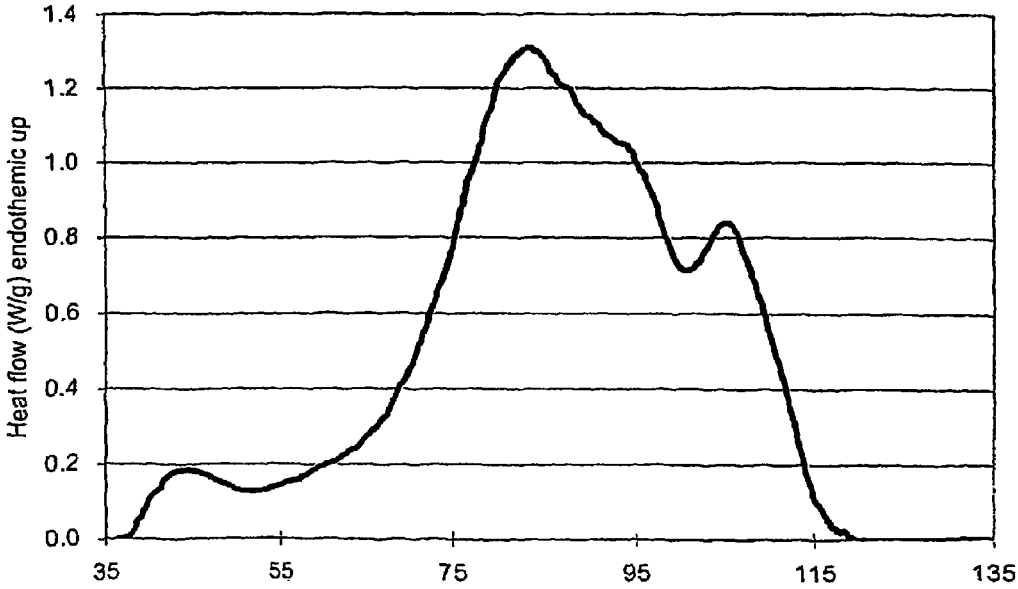

DSC test results were determined by running one heating followed by one cooling followed by one heating cycle each at 10° C. per minute, with an initial heating and cooling cycle prior to the second heating during which test measurements were made. FIG. 1 represents a sample DSC measurement for Wax-A.

Wax-A was further characterized by $^{13}$C-NMR as;

0.13 methyl branches per 100 carbon atoms, 0.05 ethyl branches per 100 carbon atoms and 0.05 butyl branches per 100 carbon atoms.

$^{13}$C NMR spectrum was quantitatively analyzed to determine the numbers of branching carbons in the molecule. The NMR instrumentation included a Varian UnityPlus 400 with sample preparation utilizing the proton complete decoupling method as follows having;

a resonance frequency: 100.56 MHz a temperature: 130 C

Crystallinity was calculated utilizing Igor Pro Software from Wavemetrics Corporation to separate and identify the peaks to crystal faces.

Wax-A was also characterized by having a molecular weight polydispersity (Mw/Mn) of 1.3, with the number average molecular weight Mn of 750 and the weight average molecular weight Mw of 965.

Molecular Weight test results were determined by GPC analysis using PL-210 instrument from Polymer Laboratories, using a 30 cm×4 column of TSGgel GMH-HT (Toso) and ODCB (o-dichlorobenzene) as eluent, and a refractive index (RI) detector. The flow rate was 1.0 mL/min. The sample was injected as a 0.1 wt % solution in the eluent and in an amount of 500 μL. The column temperature was maintained at 135° C. The results were determined against a polystyrene standard with a cubic fit calibration curve, along with a universal calibration curve with the viscosity equation of polystyrene standard and polyethylene of Kps=1.38E-4, α ps=0.70, Kpe=4.77E-4, α pe=0.70.

Figure 2:
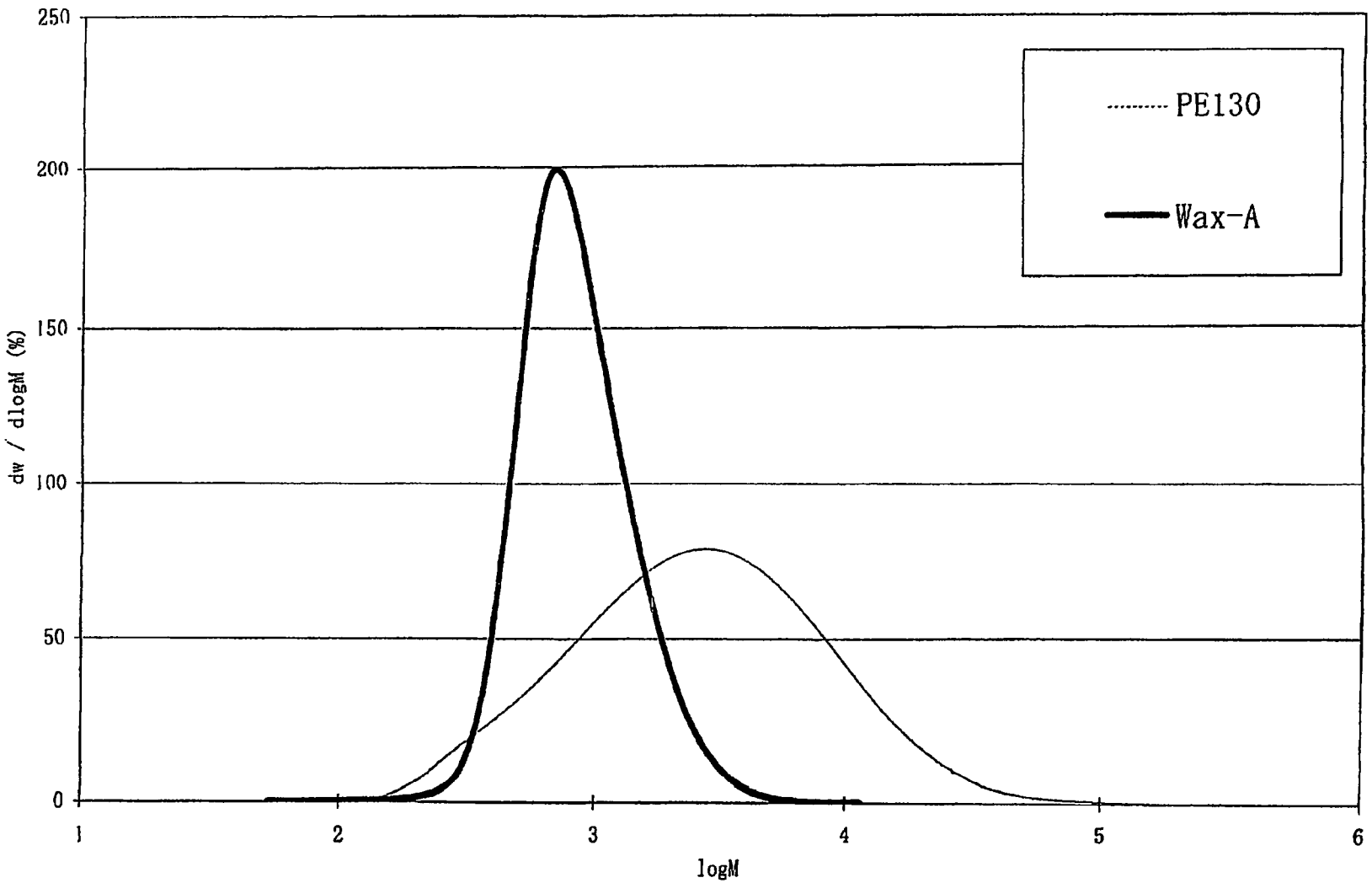
FIG. 2 provides a GPC (gel permeation chromatography) plot comparing a most preferred wax used in the toner of the present invention with PE 130.

The sample was prepared by dissolving the wax in ODCB with heating at 135° C. in an oil bath, followed by filtering the hot solution with a 3 um PTFE filter. FIG. 2 illustrates the drastic differences in molecular weight distributions between PE 130 and Wax-A.

The composition of the present invention (containing Wax-A) showed significantly higher ID than any of the other formulations tested, which only differed in the type of wax that was used.

This application is based on U.S. provisional application Ser. No. 60/408,878, filed Sep. 9, 2002, the entire contents of which are hereby incorporated by reference.

Obviously, additional modifications and variations of the present invention are possible in light of the above teachings. It is therefore to be understood that within the scope of the appended claims, the invention may be practiced otherwise than as specifically described herein.

The invention claimed is:

1. An electrostatic developer, comprising:

toner-containing image-forming particles and an uncrosslinked, linear hydrocarbon based homopolymer wax, wherein said wax has a total number of branches in each of one or more chains that is less than 0.5%, relative to a total number of carbons in said wax, wherein said wax has a set of endotherm peaks as determined by differential scanning calorimetry (DSC) run at a maximum rate of 10° C. per minute at increasing temperature, said endotherm peaks including a primary endotherm peak and at least a secondary endotherm peak, said primary endotherm peak in a temperature range of between 70° C. and 90° C. and said secondary endotherm peak in a temperature range of between 95° C. and 110° C.;

wherein said wax has a crystallinity of from 78 to 82% as determined by small angle X-ray diffraction analysis;

wherein said wax has a molecular weight polydispersity (Mw/Mn) in the range of 1.1-1.3, wherein the number average molecular weight, Mn, is in the range of 700-790 and the weight average molecular weight, Mw, is in the range of 890-1000; and wherein said wax has the following branching:

0-0.20 methyl branches per 100 carbon atoms, 0-0.10 ethyl branches per 100 carbon atoms and 0-0.10 butyl branches per 100 carbon atoms.

2. The electrostatic developer of claim 1, wherein said wax is further characterized by a particle size in the range of 1 to 10 μm.

3. The electrostatic developer of claim 1, wherein said wax is obtained by a process comprising:

in a reactor vessel, gasifying and subsequently liquifying coal to produce a wax residue in the reactor vessel, said reactor vessel containing sides with interior surfaces, wherein the wax residue forms on said surfaces;

milling said wax residue, substantially by a jet mill to accomplish micronizing of the wax.

4. The electrostatic developer of claim 1, wherein said toner is a monocomponent toner.

5. The electrostatic developer of claim 1, wherein said toner is a dual component toner.

6. The electrostatic developer of claim 5, wherein said toner further comprises magnetic particles.

7. The electrostatic developer of claim 1, wherein said toner further comprises a binder resin.

8. The electrostatic developer of claim 1, wherein said toner further comprises a binder resin, and wherein said wax is present in an amount of 0.1-20 parts by weight per 100 parts of the binder resin.

9. The electrostatic developer of claim 1, said toner further comprises a binder resin, and wherein said wax is present in an amount of 0.1-7.0 parts by weight per 100 parts of binder resin.

10. The electrostatic developer of claim 1, said toner further comprises a binder resin, and wherein said wax is present in an amount of 1.0-6.0 parts by weight per 100 parts of binder resin.

11. The electrostatic developer of claim 1, further comprising one or more inorganic oxides selected from the group consisting of $SiO_2$, $Al_2O_3$, $W_2O_3$, $ZrO_2$, SeO, $TiO_2$, ZnO, MgO, and mixtures thereof.

12. A toner cartridge comprising a cartridge and the electrostatic developer according to claim 1.

13. In an electrophotographic apparatus, wherein the improvement comprises the use of a toner cartridge according to claim 12.

14. An electrostatic developer, comprising:

toner-containing image-forming particles and an uncrosslinked, linear hydrocarbon based homopolymer wax;

wherein said wax has a total number of branches in each of one or more chains that is less than 0.5%, relative to a total number of carbons in said wax;

wherein said wax has a set of endotherm peaks as determined by differential scanning calorimetry (DSC) run at a maximum rate of 10° C. per minute at increasing temperature, said endotherm peaks including a primary endotherm peak and at least a secondary endotherm peak, said primary endotherm peak in a temperature range of between 70° C. and 90° C. and said secondary endotherm peak in a temperature range of between 95° C. and 110° C.; and wherein said wax has a crystallinity of from 75 to 90% as determined by small angle X-ray diffraction analysis.

15. The electrostatic developer of claim 14, wherein said wax has a molecular weight polydispersity (Mw/Mn) in the range of 1.1-1.3, wherein the number average molecular weight, Mn, is in the range of 700-790 and the weight average molecular weight, Mw, is in the range of 890-1000; and wherein said wax has the following branching:

>0 to 0.20 methyl branches per 100 carbon atoms,

>0 to 0.10 ethyl branches per 100 carbon atoms, and

>0 to 0.10 butyl branches per 100 carbon atoms.

* * * * *